US009089990B2

(12) United States Patent
Kamite

(10) Patent No.: US 9,089,990 B2
(45) Date of Patent: Jul. 28, 2015

(54) PROCESS FOR PRODUCING WOODEN SYNTHETIC CONSTRUCTION MATERIAL

(75) Inventor: Masayuki Kamite, Tokyo (JP)

(73) Assignee: HANDY TECHNO CO., LTD., Tokyo (JP)

( * ) Notice: Subject to any disclaimer, the term of this patent is extended or adjusted under 35 U.S.C. 154(b) by 141 days.

(21) Appl. No.: 14/009,424

(22) PCT Filed: Apr. 4, 2012

(86) PCT No.: PCT/JP2012/059227

§ 371 (c)(1),
(2), (4) Date: Oct. 2, 2013

(87) PCT Pub. No.: WO2012/137833

PCT Pub. Date: Oct. 11, 2012

(65) Prior Publication Data

US 2014/0027942 A1 Jan. 30, 2014

(30) Foreign Application Priority Data

Apr. 5, 2011 (JP) ..... 2011-083481

(51) Int. Cl.
*B27N 3/00* (2006.01)
*B27N 3/02* (2006.01)
*B27N 3/28* (2006.01)

(52) U.S. Cl.
CPC *B27N 3/002* (2013.01); *B27N 3/02* (2013.01); *B27N 3/28* (2013.01)

(58) Field of Classification Search
CPC ..... B27N 3/002; B27N 3/02
See application file for complete search history.

(56) References Cited

U.S. PATENT DOCUMENTS 5,441,801 A 8/1995 Deaner et al.
5,620,642 A 4/1997 Kamite et al.

(Continued)

FOREIGN PATENT DOCUMENTS

CN 1222877 A 7/1999
JP 09-216500 A 8/1997

(Continued)

OTHER PUBLICATIONS

International Search Report (ISR) dated May 22, 2012 (and English translation thereof) issued in International Application No. PCT/JP2012/059227.

(Continued)

*Primary Examiner* — Jill Heitbrink
(74) *Attorney, Agent, or Firm* — Holtz, Holtz, Goodman & Chick PC

(57) ABSTRACT

A process for producing a high utility wooden synthetic construction material, with a woodgrain appearance close to the texture of natural wood, which effectively uses waste in the form of a wood powder of plywood. A wood powder of plywood, manufactured by adding an adhesive to wood fibers or chips and pressurizing, and a thermoplastic synthetic resin are used as main raw materials. A material obtained by adding an auxiliary raw material to the main raw materials is heated and melted at 160° C. to 200° C., and then pelletized to obtain raw material pellets. The raw material pellets are loaded into an extrusion molding or an injection molding machine, without actively removing contained moisture derived from the wood powder of plywood and an adhesive component from the raw material pellets, heated and melted at 150° C. to 200° C., and extruded from the mold or injected into the mold.

5 Claims, 4 Drawing Sheets

(56) References Cited

U.S. PATENT DOCUMENTS

| | | | | |
|---|---|---|---|---|
| 5,869,138 | A | 2/1999 | Nishibori | |
| 5,882,564 | A | 3/1999 | Puppin | |
| 6,066,367 | A | 5/2000 | Nishibori | |
| 2002/0106498 | A1 * | 8/2002 | Deaner et al. | 428/292.4 |
| 2002/0153107 | A1 | 10/2002 | Roffael | |

FOREIGN PATENT DOCUMENTS

| | | | |
|---|---|---|---|
| JP | 10-138212 | A | 5/1998 |
| JP | 2001-505829 | A | 5/2001 |
| JP | 3085797 | U | 5/2002 |
| JP | 2002-187116 | A | 7/2002 |
| JP | 2002-225011 | A | 8/2002 |
| JP | 2003-003660 | A | 1/2003 |
| JP | 2006-103014 | A | 4/2006 |
| JP | 2006-150786 | A | 6/2006 |
| JP | 2006-192741 | A | 7/2006 |
| JP | 2006-305981 | A | 11/2006 |
| WO | WO 94/20280 | A1 | 9/1994 |

OTHER PUBLICATIONS

Chinese Office Action dated Sep. 25, 2014, issued in counterpart Chinese Application No. 201280016746.0.

* cited by examiner

PROCESS FOR PRODUCING WOODEN SYNTHETIC CONSTRUCTION MATERIAL

TECHNICAL FIELD

The present invention relates to a process for producing a construction material suitable for window frames, decks, terraces, fences, railings, pillars, louvers, benches, and other applications, and more particularly to a wooden synthetic construction material molded using a mixture of a wood powder of plywood and a thermoplastic synthetic resin as a raw material.

BACKGROUND ART

Natural materials such as timber have conventionally been used as main construction materials, but wooden synthetic construction materials that are molded from a mixture of a wood powder and a thermoplastic synthetic resin have recently become known and been used as exterior construction materials and interior construction materials. Such wooden synthetic construction materials have attracted much attention because they enable the effective use of wastes (wastes of natural wood or synthetic construction materials) and make it possible to save oil resources serving as source materials and reduce the production cost.

CITATION LIST

Patent Literature 1: Japanese Patent Publication No. 2006-192741

Patent Literature 2: Japanese Patent Publication No. 2006-305981

Patent Literature 3: Japanese Patent Publication No. 2003-3660

Patent Literature 4: Japanese Patent Publication No. 2002-187116

Patent Literature 5: Japanese Patent Publication No. H09-216500

SUMMARY OF INVENTION

Technical Problem

Moisture contained in a wood powder is known to cause problems when a resin is molded while admixing a raw material with the wood powder mixed therein. Further, where a wood powder that is a waste of a synthetic construction material or a wood powder of plywood (a plate material manufactured by adding an adhesive to wood fibers or chips and pressurizing) is used, problems are associated not only with moisture, but also with the adhesive component.

More specifically, where extrusion molding or injection molding is performed under general molding conditions by using a raw material with moisture or an adhesive component remaining therein, molding becomes impossible due to abnormal foaming, or strains appear in the molded product and the designed molded product cannot be obtained. Problems can be also associated with the appearance (roughened surface) and quality (spread in strength occurs or a sufficient strength cannot be obtained). Therefore, to avoid those problems, it is preferred that the moisture and adhesive component be completely removed from the raw material (powder or pellets).

Accordingly, in the conventional process for producing a wooden synthetic construction material using a wood powder, raw material pellets are produced by mixing a wood powder and a synthetic resin, and those raw material pellets are then dried. Such drying minimizes the moisture content in the raw material pellets.

However, when an adhesive component is contained in the wood powder used, that is, when wastes of synthetic construction materials or a wood powder from plywood, rather than the powder of natural wood, is used, the adhesive component is difficult to remove by only drying the raw material pellets. Therefore, when a wooden synthetic construction material is manufactured by using wastes of synthetic construction materials or a wood powder from plywood, in order to avoid advantageously the above-described problems associated with external appearance, quality or handling, it is considered to be effective to reduce the compounding ratio of the wood powder (for example, to 15 wt % or less of the synthetic resin raw material to be mixed therewith) or heat the wood powder at a high temperature (for example, a temperature equal to or higher than 100° C.) for a sufficient time, thereby evaporating in advance the moisture and adhesive component contained in the wood powder, and then blend and pelletize the raw material.

However, where the compounding ratio of the wood powder is decreased, a problem is associated with the effective utilization of wastes. In addition, a molded product with wood texture is difficult to obtain, no contribution is made to saving oil resources, and the raw material cost rises. Yet another problem is that where long-term heating is performed at a high temperature (for example, a temperature equal to or higher than 150° C.) with the object of evaporating the adhesive component present in the wood powder, the wood powder itself is changed (carbonized, etc.), discolored and decomposed, and the original state thereof cannot be maintained. Furthermore, the time required for processing is extended, energy consumption is increased and production cost is raised.

The present invention has been created to resolve the above-described problems inherent to the related art, and it is an object of the present invention to provide a process for producing a wooden synthetic construction material of very high utility, which enables effective use of wood powder of plywood wastes and can save oil resources, reduce the raw material cost, and produce a synthetic construction material with a woodgrain appearance close to the texture of natural wood.

Solution to Problem

The process for producing a wooden synthetic construction material in accordance with the present invention uses, as main raw materials, a thermoplastic synthetic resin and a wood powder of plywood manufactured by adding an adhesive to wood fibers or chips and pressurizing, the process including: heating and melting a material obtained by adding an auxiliary raw material to the main raw materials, under temperature conditions of 160° C. to 200° C., then pelletizing the material to obtain raw material pellets, loading the raw material pellets into an extrusion molding machine or an injection molding machine, without actively removing a contained moisture derived from the wood powder of plywood and a contained adhesive component from the raw material pellets, heating and melting the raw material pellets under temperature conditions of 150° C. to 200° C., thereby causing variations in specific gravity depending on a location in the raw material inside a cylinder, extruding the raw material pellets from a mold or injecting the same into a mold, thereby creating a woodgrain flow pattern on the surface of a molded product by using the remaining moisture and adhesive component, and forming a complex structure (a state in which raw materials of different forms are randomly entangled with each other) serving as a basis for a flow pattern inside the molded product.

It is preferred that 100 parts by weight of the thermoplastic synthetic resin and 30 parts by weight to 100 parts by weight of the wood powder of plywood be compounded as the main raw materials, and 5 parts by weight to 10 parts by weight of a filler and 2 parts by weight to 3 parts by weight of a pigment be compounded as the auxiliary raw materials, and it is preferred that a polyvinyl chloride powder, a polystyrene powder, a polyethylene powder, or a polypropylene powder be used as the thermoplastic synthetic resin. It is also preferred that a material obtained by adding an acrylic resin to one material selected from among a polyvinyl chloride powder, a polystyrene powder, a polyethylene powder, and a polypropylene powder, or to a combination of two or more of such materials be used as the thermoplastic synthetic resin.

Advantageous Effects of Invention

With the process for producing a wooden synthetic construction material in accordance with the present invention, it is possible to use effectively wastes in the form of a wood powder of plywood and produce a synthetic construction material with a woodgrain appearance close to the texture of natural wood. Further, since the compounding ratio of the synthetic resin raw material can be reduced, oil resources can be saved, and because wastes are used, the raw material cost can be reduced.

DESCRIPTION OF EMBODIMENTS

Figure 1:
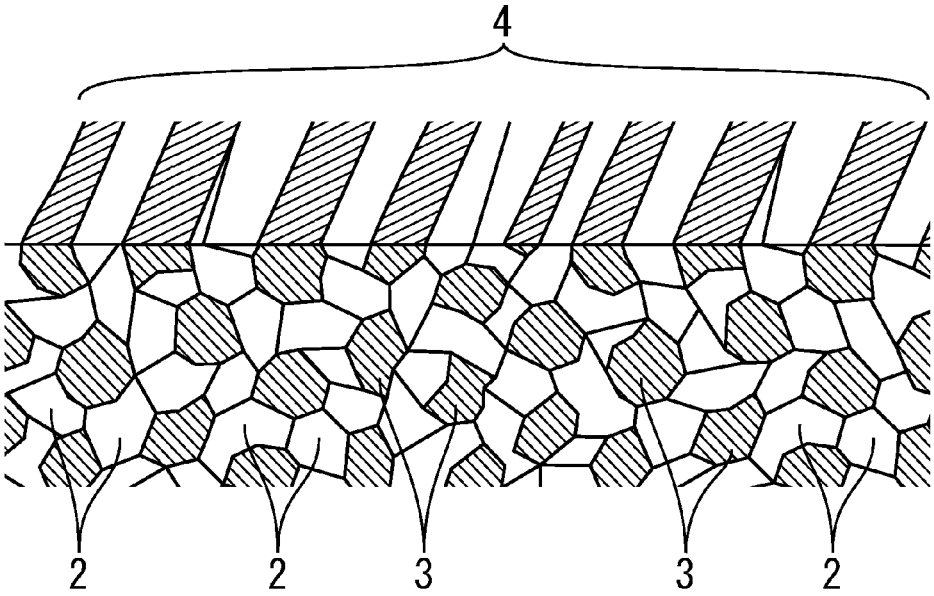
FIG. 1 illustrates schematically part of the surface 4 and cross section of the molded product obtained by the process for producing a wooden synthetic construction material in accordance with the present invention.

The embodiments of the "process for producing a wooden synthetic construction material" in accordance with the present invention will be explained below. The process for producing a wooden synthetic construction material in accordance with the present invention basically includes heating and melting a material obtained by adding an auxiliary raw material to main raw materials, pelletizing the material to obtain raw material pellets, loading the raw material pellets into an extrusion molding machine, melting by heating, and molding by extruding from the mold.

In the present embodiment, a wood powder of plywood (plywood manufactured by adding an adhesive to wood fibers or chips and pressurizing; for example, MDF (Medium Density Fiber board), HDF (High Density Fiber board), and particle board) is used in addition to a thermoplastic synthetic resin (polyvinyl chloride powder, polystyrene powder, polyethylene powder, polypropylene powder, or acrylic resin) as the main raw materials. The compounding ratio of the raw materials is 30 parts by weight to 100 parts by weight of the wood powder of plywood per 100 parts by weight of the thermoplastic synthetic resin. It is also preferred that 5 parts by weight to 10 parts by weight of a filler and 2 parts by weight to 3 parts by weight of a pigment be compounded as auxiliary raw materials.

Moisture and an adhesive component (phenolic resin, urea resin, and the like) are contained in the wood powder of plywood used as the main raw material, and where a material including the wood powder of plywood is used and raw material pellets are produced under typical temperature conditions, moisture and the adhesive component remain inside the pellets. Where extrusion molding or the like is performed under typical molding conditions by using the raw material pellets with the moisture and adhesive component remaining therein, a variety of problems, such as the above-described abnormal foaming, strains in the molded product, surface roughening, and spread in strength, occur. However, in the present embodiment, molding is performed by directly loading the raw material pellets into an extrusion molding machine, without actively removing the contained moisture and the contained adhesive component.

In this case, the above-described problems can be advantageously avoided by setting the molding conditions (heating and melting temperature, extrusion pressure, and retention time) to appropriate ranges, location-dependent variation in specific gravity can be created in the raw material before extrusion from the die (mold) (raw material inside the cylinder and inside the cavity portion from the cylinder to the die), a woodgrain flow pattern can be developed on the molded product surface, and a complex structure (a state in which raw materials of different forms are randomly entangled with each other) serving as a basis for a flow pattern inside the molded product can be formed by using the remaining moisture and adhesive component (by the change of these components). As a result, it is possible to obtain a synthetic construction material with a woodgrain appearance close to the texture of natural wood.

The molding conditions are described below. The heating and melting temperature of the raw materials is set to 150° C. to 200° C. More specifically, in the cylinder of the extrusion molding machine, the temperature is set to 120° C. to 150° C. at a location on the hoper side, to 140° C. to 190° C. at the intermediate location, and 170° C. to 190° C. at a location on the die side. Further, the temperature is set to 160° C. to 200° C. for the die. The resulting adjustment makes it possible to heat and melt the raw materials inside the extrusion molding machine with a temperature range of 150° C. to 200° C. The extrusion pressure of the raw materials is set to 10 MPa to 20 MPa. The average retention time of the raw materials inside the cylinder is set to 3 min to 10 min.

Where the raw material pellets containing moisture and the adhesive component are loaded into the extrusion molding machine and the extrusion molding is performed under the above-described molding conditions, the raw material pellets are heated and melted inside the cylinder, and the moisture and adhesive component present in the raw materials are evaporated and form gases (water vapor and other gases). In this case, the volume of the moisture and adhesive component is drastically increased (by a factor of about 1700 for water vapor), and the gases generated inside the cylinder in the region on the raw material hopper side (gases separated from the raw materials) are discharged from the raw material hopper.

The raw materials conveyed towards the die inside the cylinder are foamed in the interior and close to the surface by the evaporation of the remaining moisture and remaining adhesive component. As a result, the specific gravity in the raw material inside the cylinder varies depending on the location. More specifically, the specific gravity decreases in segments with a comparatively large remaining amount of moisture or adhesive component (the specific gravity is 1.1 to 1.25 when the thermoplastic synthetic resin used as the main raw material is of a PVC system, and 0.95 to 1.15 when the thermoplastic synthetic resin is of an olefin system) and increases in segments with a comparatively low remaining amount (1.25 to 1.4 in the case of a PVC system and 1.15 to 1.25 in the case of an olefin system).

Where the raw materials that are present inside the cylinder in a state in which the segments with a low specific gravity are intermixed with the segments with a high specific gravity are fed towards the die, without controlling the flow velocity (for example, a filter or a mesh is not mounted), and pushed into the die and extruded without performing kneading which is used to obtain a uniform specific gravity, a composite structure is obtained, as shown in FIG. 1, in which the segments 2 with a low specific gravity are randomly entangled with the segments 3 with a high specific gravity (the thickness of each segment is about 1 mm to 5 mm). Further, the segments 2 with a low specific gravity assume a comparatively light color (large foaming), whereas the segments 3 with a high specific gravity assume a comparatively deep color (foaming is small), and such a color tone shading results in the formation of a flow pattern on the surface 4 of the molded product.

Figure 2:
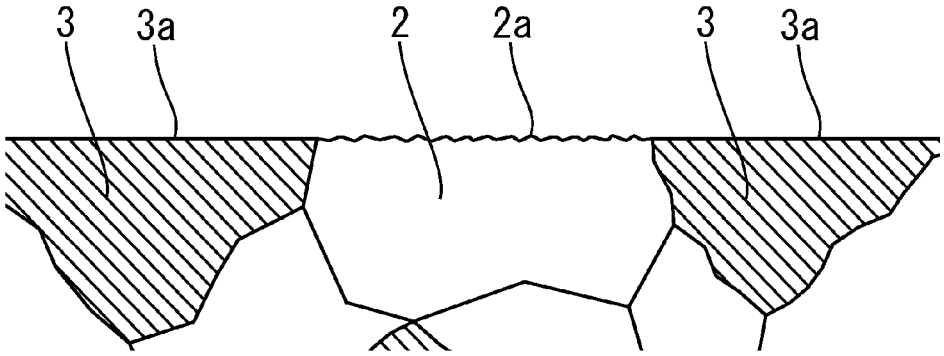
FIG. 2 is a partial enlarged view of the cross section of the molded product shown in FIG. 1.
Figure 3:
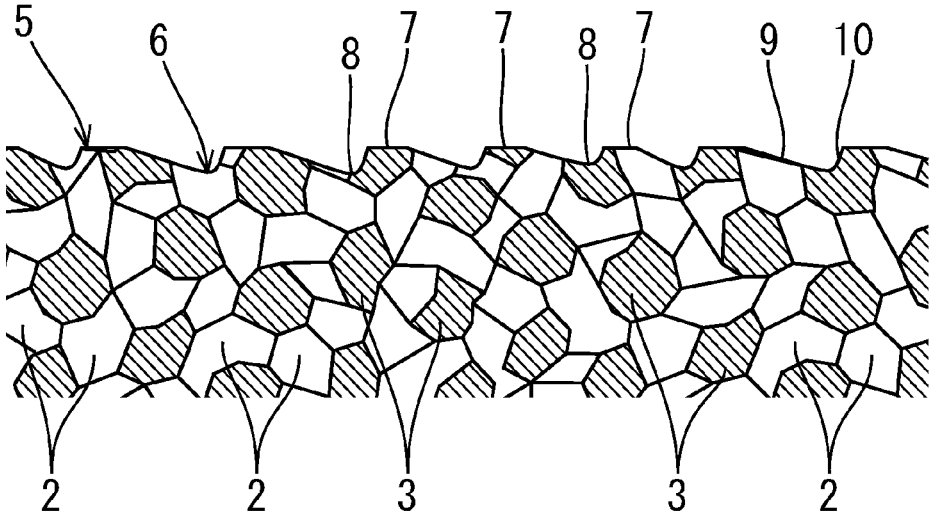
FIG. 3 illustrates another configuration example of the molded product obtained by the process for producing a wooden synthetic construction material in accordance with the present invention.

When the raw materials pass through the die and are cooled by contact with the finishing surface of the die and a cooling sizer, the segments 2 with a low specific gravity are provided with a roughened surface due to a large number of foamed portions, and a surface having tiny protrusions and depressions (uneven surface 2*a*) is formed, as shown in FIG. 2. Meanwhile, no such roughening occurs on the segments 3 with a large specific gravity due to a small number of foamed portions, and a smooth surface similar to a mirror-finish surface (smooth surface 3*a*) is formed along the finishing surface of the die. Further, such difference in texture and light reflection between the uneven surface 2*a* and the smooth surface 3*a* results in the formation of a flow pattern on the surface of the molded product.

With the process of the present embodiment, the difference in specific gravity occurring inside the raw materials creates the differences in color tone shading, texture, and light reflection, and the combination of those differences results in the formation of a flow pattern on the surface of the molded product and makes it possible to produce a wooden synthetic construction material having a woodgrain appearance close to the texture of natural wood.

The following problems are encountered when the molding conditions are outside of the above-described suitable ranges. Thus where the heating and melting temperature of the raw materials is less than 150° C., the adhesive component contained in the raw material pellets is not decomposed or foamed sufficiently, and where the temperature is higher than 200° C., the wood powder contained in the raw material pellets starts decomposing and the performance cannot be maintained. Further, the problem occurring when the extrusion pressure of the raw materials is less than 10 MPa is that the raw materials cannot be extruded form the die, and where the extrusion pressure is greater than 25 MPa, the discharge speed of the molded product from the die becomes too high, the cooling control is difficult to implement (cooling control of the cooling sizer and in the water tank), and problems are associated with die durability. Further, the problem occurring when the retention time of the raw materials is less than 3 min is that the melting of the raw material pellets and fusion of the layers formed by the melting of the raw material pellets (layers of the segments with a comparatively low specific gravity and segments with a comparatively high specific gravity) are insufficient. The problem encountered when the retention time is longer than 10 min is that abnormal foaming or decomposition of the raw materials occurs.

As described hereinabove, in the conventional processes for producing wooden synthetic construction material, moisture or an adhesive component remaining in the raw material pellets cause degradation of appearance and quality of the molded product. For this reason, it has been considered necessary to remove the moisture and adhesive component from the raw material pellets prior to molding. By contrast, in the present embodiment, by using the moisture and adhesive component present in the raw materials, that is, by setting the molding conditions to suitable ranges, it is possible to control the mode of separation thereof (moisture and volatile substances contained in the adhesive component) from the raw materials in the molding process (a process proceeding within a range from the cylinder to the die). As a result, it is possible to obtain a synthetic construction material with a woodgrain appearance close to the texture of natural wood.

Therefore, by contrast with the conventional processes for producing wooden synthetic construction materials, when the raw material pellets are produced, the moisture and adhesive component contained in the wood powder of plywood that is used as the main raw material should be controlled to remain in predetermined or greater amounts inside the produced raw material pellets. Accordingly, in the present embodiment, the raw material (material obtained by adding an auxiliary raw material to the main raw materials), is pelletized by heating and melting under temperature conditions of 160° C. to 200° C. and then cooling. Where the raw material pellets are produced under such temperature conditions, when the wood powder of plywood is compounded in an amount of 30 parts by weight to 100 parts by weight per 100 parts by weight of the thermoplastic synthetic resin, about 0.3 wt % to 0.9 wt % of moisture and about 0.5 wt % to 1 wt % of the volatile substances (toluene, xylene, and the like) contained in the adhesive component remain in the pellets.

Where the raw material pellets containing the moisture and adhesive component within the abovementioned ranges are loaded into the extrusion molding machine and the extrusion molding is performed under the aforementioned suitable molding conditions, it is possible to obtain a synthetic construction material with a woodgrain appearance close to the texture of natural wood.

In the present embodiments the wooden synthetic construction material is manufactured by loading the raw material pellets into the extrusion molding machine and extrusion molding, but it is also possible to load the raw material pellets into an injection molding machine and perform injection molding.

Figure 4:
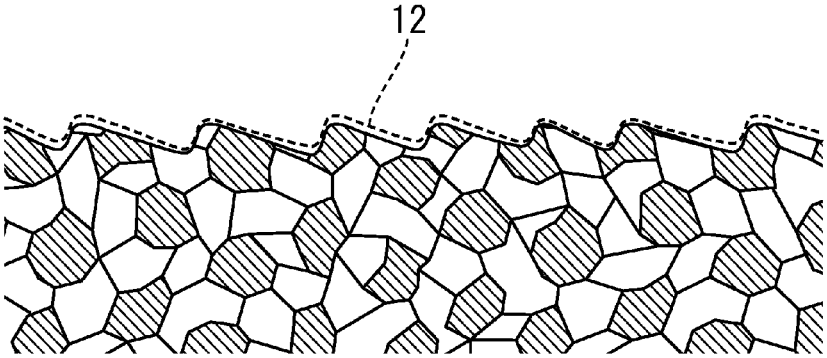
FIG. 4 is a partial enlarged view illustrating an example of the surface shape of the molded product obtained by the process for producing a wooden synthetic construction material in accordance with the present invention.

During the molding process, it is also possible to use a die in which a large number of protrusions and depressions are formed on the surface, the die being designed such that protrusions 5, depressions 6, peaks 7, deepest portions 8, gently inclined portions 9, and steeply inclined portions 10 are formed after the below-described grinding is performed and such that the spacing between the peaks 7 of the two adjacent protrusions 5, width of the peaks 7 of the protrusions 5, depth of the deepest portions 8 of the depressions 6, angles of the gently inclined portions 9 and steeply inclined portions 10, and curvature radius of the curved surfaces of the depressions 6 are arranged irregularly in the transverse direction.

Where the raw material resin is cooled after the molding and a normal-temperature state is reached, the deformation called "sink marks" (deformation caused by shrinkage occurring when the raw material resin is cooled) is known to occur in the molded body. FIG. 4 is a partial enlarged view illustrating an example of the surface shape of the molded product after the molding. In the figure, the broken line shows the contour line of the die 12. As shown in the figure, as a result of the "sink marks", the surface shape of the cooled molded product does not necessarily match the contour of the die 12.

Figure 5:
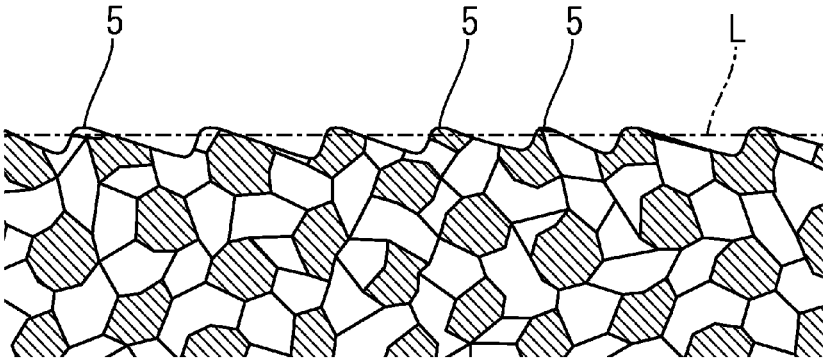
FIG. 5 is an explanatory drawing illustrating the process for producing the molded product shown in FIG. 3.
Figure 6:
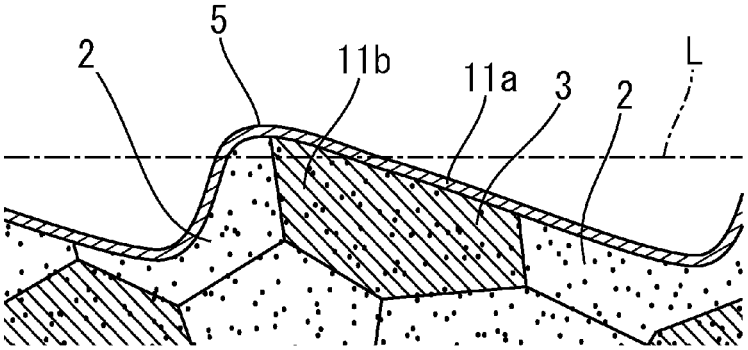
FIG. 6 is an explanatory drawing illustrating the process for producing the molded product shown in FIG. 3.
Figure 7:
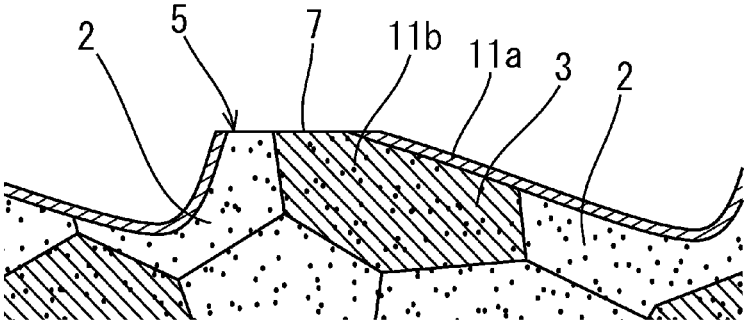
FIG. 7 is an explanatory drawing illustrating the process for producing the molded product shown in FIG. 3.

Accordingly, a step of removing the tip portions of the protrusions 5, from among a large number of protrusions 5 and depressions 6 formed on the surface, is performed along a predetermined reference line L (see FIG. 5) after the molded product has been cooled (the step of grinding the tip portions of the protrusions). The tip portions of the protrusions 5 are removed by grinding (or cutting) the tip portions of the protrusions 5 (portions above the reference line L shown in FIG. 5) by using a grinding device (or cutting device) such as a sander, a grinder, a planer, or a wire brush roll. As a result of implementing such a step, it is possible to manufacture a wooden synthetic construction material having, as a whole, a strain-free smooth surface even when a shrinkage deformation caused by the "sink marks" has occurred on the surface and the mode or degree of shrinkage deformation differs depending on location.

Where a synthetic resin mixed with a wood powder is molded by extrusion from a die, a layer with a comparatively low distribution density of the wood powder and a high distribution density of the synthetic resin (surface layer 11*a*) (see FIG. 6) is formed close to the surface. Meanwhile, a layer in which the synthetic resin and the wood powder are mixed uniformly (inner layer 11*b*) is formed inside (portion other than that close to the surface) the molded product.

Where the tip portions of the protrusions 5 (portions above the reference line L shown in FIG. 6) are cut off and removed, the inner layer 11*b* is exposed in the peaks 7 of the protrusions 5, as shown in FIG. 7, but the surface layer 11*a* remains at other portions (depressions 6, gently inclined portions 9 and steeply inclined portions 10).

In the surface layer 11*a*, the distribution density of the synthetic resin is high (the distribution density of the wood powder is low), as described hereinabove. Therefore, a smooth surface is easier formed along the finishing surface of the die in the surface layer than in the inner layer 11*b*. However, since the segments 2 with a low specific gravity have a large number of foamed portions, a roughened state is eventually reached and the uneven surface 2*a* (see FIG. 2) having tiny depressions and protrusions is formed at the portions of the surface layer 11*a* where the segments 2 with a low specific gravity are exposed. In the portions where the segments 2 with a low specific gravity are exposed, the reflectance of light decreases. Meanwhile, in the portions of the surface layer 11*a* where the segments 3 with a high specific gravity are exposed the number of foamed portions is small and therefore the roughened state is not established, the smooth surface 3*a* (see FIG. 2) is formed along the finishing surface of the die, and the reflectance of light increases.

Therefore, the portions where the segments 3 with a high specific gravity are exposed, from among the depressions 6, gently inclined portions 9 and steeply inclined portions 10 where the surface layer 11*a* remains, have a glossy appearance such that the color tone changes depending on the angle of viewing. In particular, since the vicinity of the deepest portions 8 of the depressions 6 is configured as a concave curved surface, when the segments 3 with a high specific gravity are exposed in that vicinity, the light is projected from multiple directions and multicolor color tones are obtained.

Meanwhile, in the inner layer 11*b*, the distribution density of the wood powder is higher than that in the surface layer 11*a*. Therefore, when the inner layer 11*b* is exposed outward, the wood powder appears in a large amount on the surface in a state of a mixture with the synthetic resin. Since the surface with the wood powder is not smooth, the reflectance of light is low. Therefore, the peaks 7 of the protrusions 5 where the inner layer 11*b* is exposed have a glossless color tone in which the color of the wood powder is mixed with that of the synthetic resin and the appearance such that the color tone practically does not change even when the visual line angle changes.

Therefore, on the surface, different color tones, that is, a color tone that is glossy and changes in a multicolor fashion depending on the visual line angle (depressions 6, gently inclined portions 9 and steeply inclined portions 10) and a glossless color tone resulting from the admixture of the wood powder color (peaks 7 of the protrusions 5), are demonstrated in contrast with each other. Furthermore, the segments 2 with a low specific gravity assume a comparatively light color, whereas the segments 3 with a high specific gravity assume a comparatively deep color, and the difference in texture and the difference in light reflection occur. As a consequence, a flow pattern is formed due to such color tone shading, difference in texture, and difference in light reflection even on the peaks 7 of the protrusions 5 where the inner layer 11*b* is exposed and even at the depressions 6, gently inclined portions 9 and steeply inclined portions 10 where the surface layer 11*a* remains. As a result, because of such uneven color tone, uneven light reflection, and flow pattern, the surface of the wooden synthetic construction material can be produced as a smooth surface with a natural wood feel that has a woodgrain appearance close to the texture of natural wood.

Further, in the case of the configuration of the wooden synthetic construction material in which the inclined portions of two kinds, namely, the gently inclined portions 9 with a comparatively gentle inclination angle and the steeply inclined portions 10 with a larger inclination angle, are disposed in a one-to-one combination between the two protrusions 5 or between the two depressions 6, and the protrusions 5 and the depressions 6 have a shape that is left-right asymmetrical with respect to the center of the peak 7 or the deepest portion 8, it is possible to form a surface with an appearance which has a more uneven color tone and more uneven light reflection caused by the shape and which is closer to the natural wood texture than the surface of the conventional wooden synthetic construction material.

This issue will be explained below in greater detail. Natural wood has wood grains constituted by hard portions of a deep color and soft portions of a light color, and even if they are processed to a smooth surface at the production stage, where such wood materials are exposed for a long period of time to rain or sunlight, depressions and protrusions appear on the surface along the woodgrain portions (boundary portions of annual rings). Such uneven surface shape is formed because the portions between the wood grains sink and recede, whereas the wood grain portions raise relative thereto as protrusions. Further, in most cases the inclination of the wood grain protrusions on one side is comparatively gentle, but the inclination on the opposite side is steep. Such a trend is demonstrated more markedly in the plain-sawn lumber than in the quarter-sawn lumber.

When the inclined portions of two kinds, namely, the gently inclined portions 9 with a comparatively gentle inclination angle and the steeply inclined portions 10 with a larger inclination angle, are disposed in a one-to-one combination between the two protrusions 5 or between the two depressions 6, a shape can be obtained that simulates the shape that changes with time in the above-described natural wood materials. Further, the light incidence angle relating to one visual line angle differs between the gently inclined portions 9 and the steeply inclined portions 10 and the appearance with different color tones is obtained. Therefore, it is possible to obtain a wooden synthetic construction material having a texture closer to that of the natural wood than the texture of the conventional synthetic construction materials.

Further, in the case of a configuration in which the distance between the peaks 7 of the two adjacent protrusions 5, the width of the peaks 7 of the protrusions 5, the depth of the deepest portions 8 of the depressions 6, the inclination angle of the gently inclined portions 9, the inclination angle of the steeply inclined portions 10, and the curvature radius of the curved surfaces constituting the depressions 6 are not constant, a plurality of variations is set for each of the aforementioned factors, and where those are arranged irregularly, the surface has an appearance in which a variety of color tones are combined in a complex manner, and a flat surface with the texture of natural wood can be configured even when only one resin raw material (a material of one kind in which a thermoplastic synthetic resin, a wood powder, and an auxiliary raw material are mixed together) is used.

Figure 8:
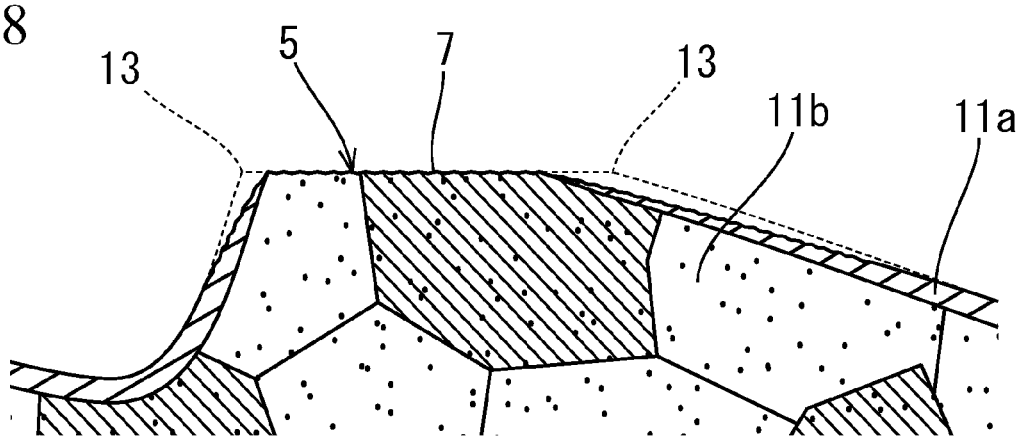
FIG. 8 is an explanatory drawing illustrating the process for producing the molded product shown in FIG. 3.

When the peaks 7 such as shown in FIG. 7 are formed by grinding the tip portions of the protrusions and then both shoulder portions 13 of the peaks 7 of the protrusions 5 are ground to obtain a state such as shown in FIG. 8 (a step of grinding the shoulder portions of the protrusions) by using a grinding device having a flexible grinding portion, such as a wire brush roll, the surface layer 11*a* is ground to a certain degree, thereby producing an appearance with features intermediate between those of the surface layer 11*a* and the inner layer 11*b*. More specifically, the layer produced by grinding the shoulder portions 13 shown in FIG. 8 with a wire brush roll or the like has the distribution density of the wood powder lower than that in the inner layer 11*b* and higher than that on the surface side of the surface layer 11*a*. Therefore, the degree of gloss is also between that of the surface side of the surface layer 11*a* and the inner layer 11*b*. Therefore, an appearance is obtained in which a larger number of color tones are combined in a complex manner, and the surface is configured as a flat surface having the texture closer to the texture of natural wood.

It is also possible to remove the tip portions of the protrusions 5 and cut off the shoulder portions 7*a* of the protrusions 5 at the same time in a single step by using a grinding device such as a wire brush roll, instead of implementing the step of grinding the shoulder portions of the protrusions after implementing the step of grinding the tip portions of the protrusions.

Figure 9:
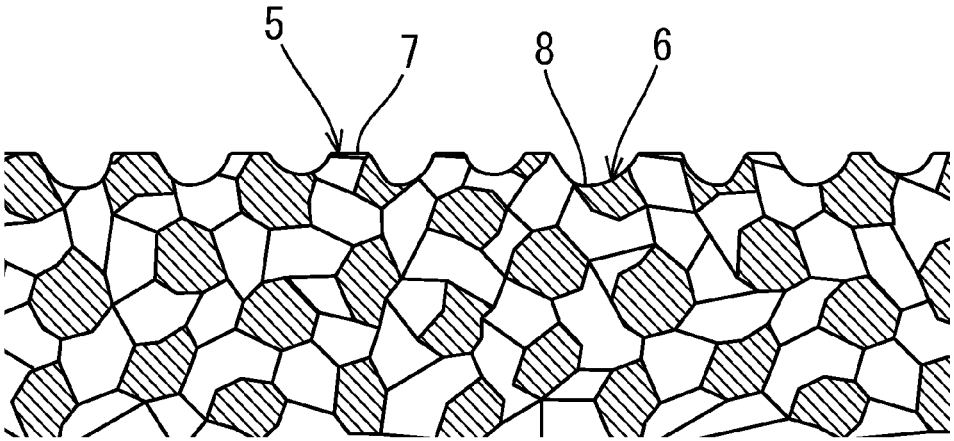
FIG. 9 illustrates another configuration example of the molded product obtained by the process for producing a wooden synthetic construction material in accordance with the present invention.

Further, it is also possible to perform the molding by using a die such that the basic shapes of the protrusions 5 and depressions 6 extending in the longitudinal direction on the surface are formed as curved surfaces, rather than inclined surfaces, as shown in FIG. 9. In this case, it is preferred that a plurality of variations be set for the curvature radius of those curved surfaces and that they be arranged irregularly. It is also preferred that the protrusions 5 (30% or more (preferably 50% or more) of all of the protrusions 5 formed at one surface) be configured to have a left-right asymmetrical shape with respect to the center of the peaks 7.

In the case of such a configuration, it is possible to form a surface with a wood texture in which a glossy color tone that changes in a multicolor fashion depending on the visual line angle and a glossless color tone resulting from the admixture of the wood powder color are demonstrated in contrast with each other. Further, when a configuration is used in which the curved surfaces with different curvature radii are irregularly arranged as the curved surfaces from the peaks 7 of the protrusions 5 to the deepest portions 8 of the depressions 6 and the protrusions 5 and depressions 6 have left-right asymmetrical shapes with respect to the center of the peaks 7 or the deepest portions 8, it is possible to form a surface that has a texture closer to that of the natural wood than the surface of the conventional wooden synthetic construction materials.

Further, in the case of a configuration in which the distance between the peaks 7 of the two adjacent protrusions 5, the width of the peaks 7 of the protrusions 5, and the depth of the deepest portions 8 of the depressions 6 are not constant, a plurality of variations is set for each of the aforementioned factors, and where those are arranged irregularly, the surface has an appearance in which a variety of color tones are combined in a complex manner, and a flat surface with the natural wood texture can be configured even when only one resin raw material (a material of one kind in which a thermoplastic synthetic resin, a wood powder, and an auxiliary raw material are mixed together) is used.

In FIGS. 1 to 9, the segments 2 with a low specific gravity and the segments 3 with a high specific gravity are presented schematically by clearly distinguishing the segments of two types for the sake of convenience, but actually no clear boundary line exists between the segments of two types, and a stepless variation mode (gradation) is demonstrated with respect to the difference in specific gravity values and color shading.

REFERENCE SIGNS LIST

2 segment with a low specific gravity
2*a* uneven surface
3 segment with a high specific gravity
3*a* smooth surface
4 surface
5 protrusion
6 depression
7 peak
8 deepest portion
9 gently inclined portion
10 steeply inclined portion
11*a* surface layer
11*b* inner layer
12 die
13 shoulder portion

The invention claimed is:

1. A process for producing a wooden synthetic construction material by using, as main raw materials, a thermoplastic synthetic resin and a wood powder of plywood manufactured by adding an adhesive to wood fibers or chips and pressurizing, the process comprising:

heating and melting a material obtained by adding an auxiliary raw material to the main raw material obtained by compounding 100 parts by weight of the thermoplastic synthetic resin and 30 parts by weight to 100 parts by weight of the wood powder of plywood, under temperature conditions of 160° C. to 200° C., and then pelletizing the material to obtain raw material pellets in which moisture remains at 0.3 wt % to 0.9 wt % and a volatile substance contained in an adhesive component remains at 0.5 wt % to 1 wt %; and loading the raw material pellets into an extrusion molding machine or an injection molding machine, without actively removing the contained moisture derived from the wood powder of plywood and the contained adhesive component from the raw material pellets, heating and melting the raw material pellets in a range of 150° C. to 200° C., establishing a state in which the raw material conveyed inside a cylinder of the extrusion molding machine or the injection molding machine is foamed internally and close to the surface by evaporation of the remaining moisture and the remaining adhesive component, and extruding the raw material in this state from the mold or injecting the raw material in this state into the mold, thereby creating variations in specific gravity and variations in flow and forming a pattern on a surface and in an interior of a molded product.

2. The process for producing a wooden synthetic construction material according to claim 1, wherein:

the raw material pellets are loaded into the extrusion molding machine set to 120° C. to 150° C. for a hopper-side location, 140° C. to 190° C. for an intermediate location, 170° C. to 190° C. for a die-side location, and 160° C. to 200° C. for a die, heated and melted, and then extruded from the mold.

3. The process for producing a wooden synthetic construction material according to claim 2, wherein:

a retention time of the raw materials inside the cylinder is 3 min to 10 min.

4. The process for producing a wooden synthetic construction material according to claim 2, wherein:

the raw material in which segments with a small specific gravity and segments with a large specific gravity are present in a mixed state due to evaporation of the remaining moisture and the remaining adhesive component inside a cylinder is conveyed towards the die without controlling a flow speed, introduced into the die without performing kneading for obtaining uniform specific gravity, and extruded to form a multiple structure in which segments with a small specific gravity and segments with a large specific gravity are randomly entangled with each other in the molded product.

5. The process for producing a wooden synthetic construction material according to claim 3, wherein:

the raw material in which segments with a small specific gravity and segments with a large specific gravity are present in a mixed state due to evaporation of the remaining moisture and the remaining adhesive component inside a cylinder is conveyed towards the die without controlling a flow speed, introduced into the die without performing kneading for obtaining uniform specific gravity, and extruded to form a multiple structure in which segments with a small specific gravity and segments with a large specific gravity are randomly entangled with each other in the molded product.

* * * * *